United States Patent [19]

Lavinsky et al.

[11] Patent Number: 4,814,800

[45] Date of Patent: Mar. 21, 1989

[54] LIGHT SHOW PROJECTOR

[75] Inventors: Joshua F. Lavinsky, 350 S. San Fernando Blvd., #301, Burbank, Calif. 91502; Mark A. Marsella, Worcester, Mass.; Paul G. Crumley, Verona, Pa.

[73] Assignee: Joshua F. Lavinsky, Burbank, Calif.

[21] Appl. No.: 168,679

[22] Filed: Mar. 16, 1988

[51] Int. Cl.[4] ..... A63J 17/00

[52] U.S. Cl. ..... 353/50; 353/84; 353/98; 362/811

[58] Field of Search ..... 272/8 P, 8 M, 10; 362/811; 353/1, 2, 84, 98, 99, 50, 51, 15–19, 31, 84; 84/464

[56] References Cited

U.S. PATENT DOCUMENTS

| | | | |
|---|---|---|---|
| 1,824,859 | 8/1931 | Woodford . | |
| 2,411,804 | 11/1946 | Plebanck . | |
| 2,677,297 | 5/1954 | Wetzel . | |
| 3,163,077 | 12/1964 | Shank . | |
| 3,163,078 | 12/1964 | Elliott . | |
| 3,318,187 | 5/1967 | Prohaska . | |
| 3,563,130 | 2/1971 | Elliott . | |
| 3,572,919 | 3/1971 | Hayes et al. . | |
| 3,590,681 | 7/1971 | Cross . | |
| 3,603,195 | 9/1971 | Williams | 353/15 X |
| 3,892,478 | 8/1975 | Lampkin . | |
| 4,006,970 | 2/1977 | Slater | 84/464 X |
| 4,101,361 | 3/1977 | Latterman et al. . | |
| 4,196,461 | 4/1980 | Geary | 362/259 |
| 4,205,585 | 6/1980 | Hornick . | |
| 4,227,785 | 10/1980 | Herbert . | |
| 4,327,975 | 5/1982 | Harris . | |

*Primary Examiner*—Harry N. Haroian

*Attorney, Agent, or Firm*—Kelly, Bauersfeld & Lowry

[57] ABSTRACT

A light show projector is provided for use in producing a pleasing and variable laser-like visual line pattern on a wall or the like in synchronized relation with an audio input signal such as music. The light show projector comprises a compact and portable housing having a substantially point light source projecting a narrow light beam through a rotatable color wheel having multiple radial segments of different colors, and further through an adjustable focusing lens for reflection by a dynamically supported mirror onto a wall or ceiling of a room for viewing. The mirror is resiliently supported by asymmetrically arranged support members, one of which is electromagnetically displaced in relation to selected characteristics of the audio input signal, thereby producing a multidimensional mirror displacement yielding a large and widely variant esthetically attractive laser-like line pattern. The appearance of the line pattern is enhanced by variably driving the color wheel in relation to other characteristics of the input signal to produce a changing multicolored display for observation while listening to music.

29 Claims, 5 Drawing Sheets

FIG. 1
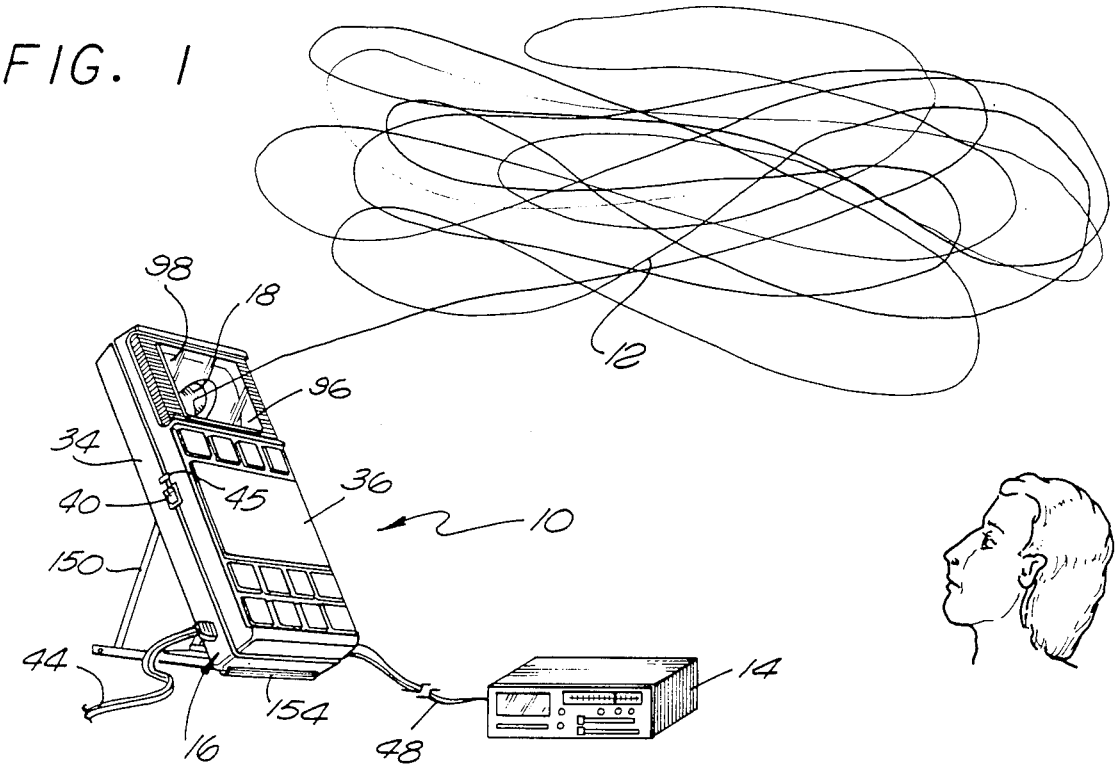
FIG. 2
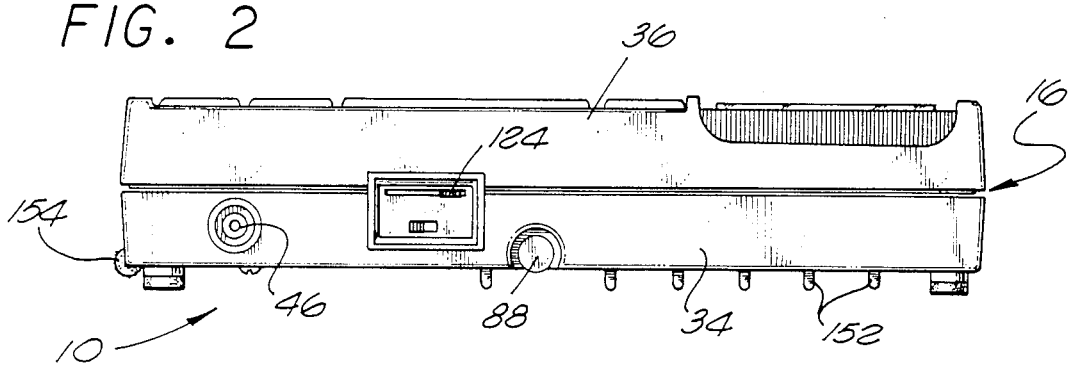
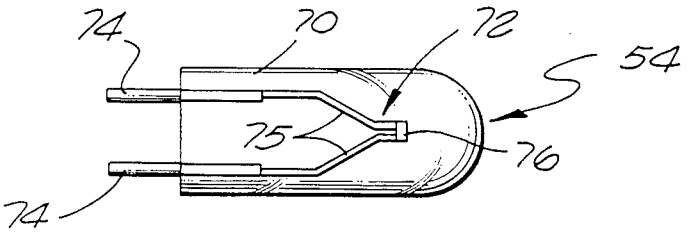
FIG. 5

FIG 3
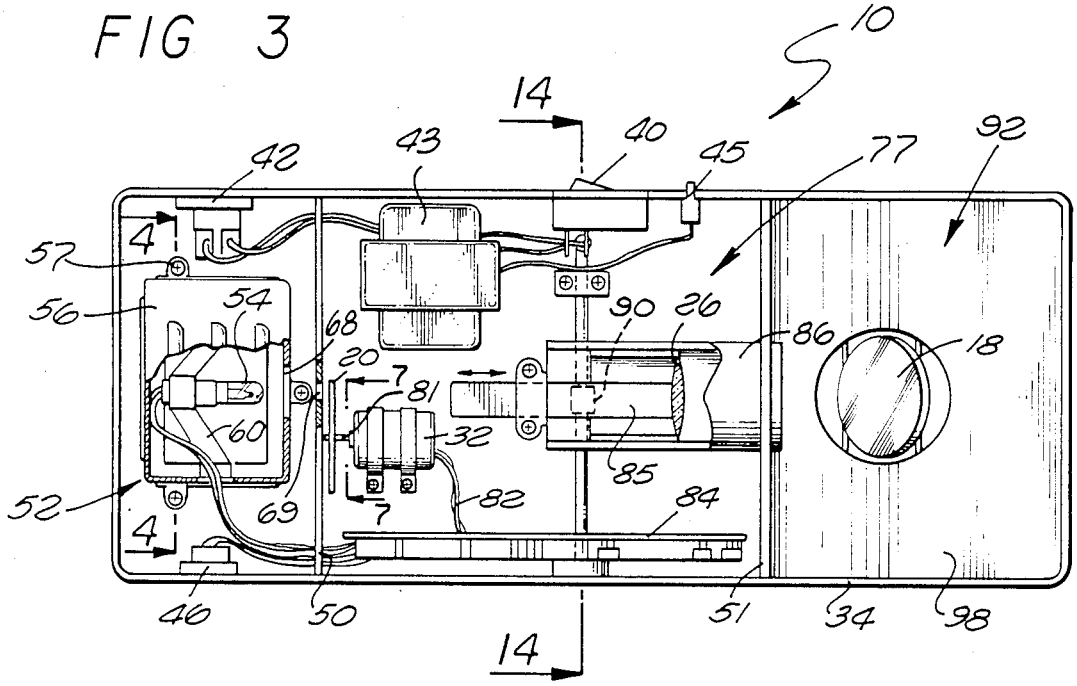
FIG. 4
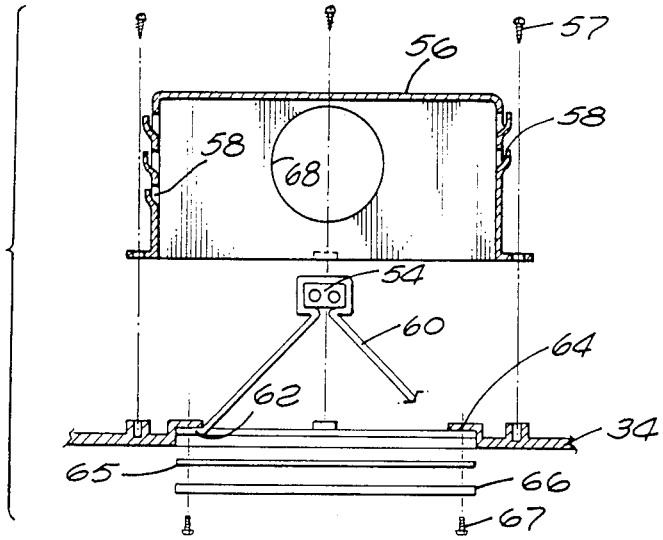
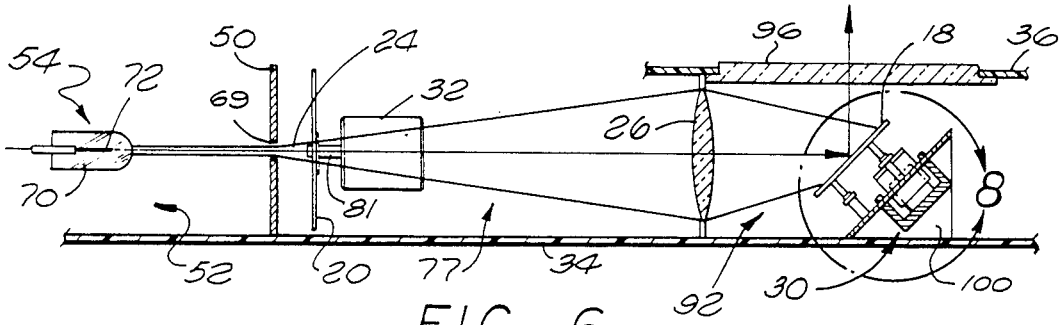
FIG. 6

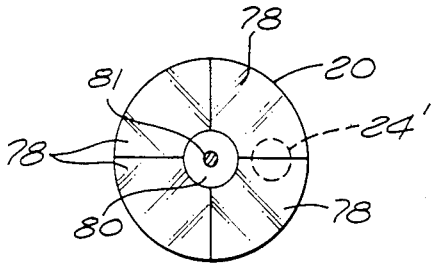
FIG. 7
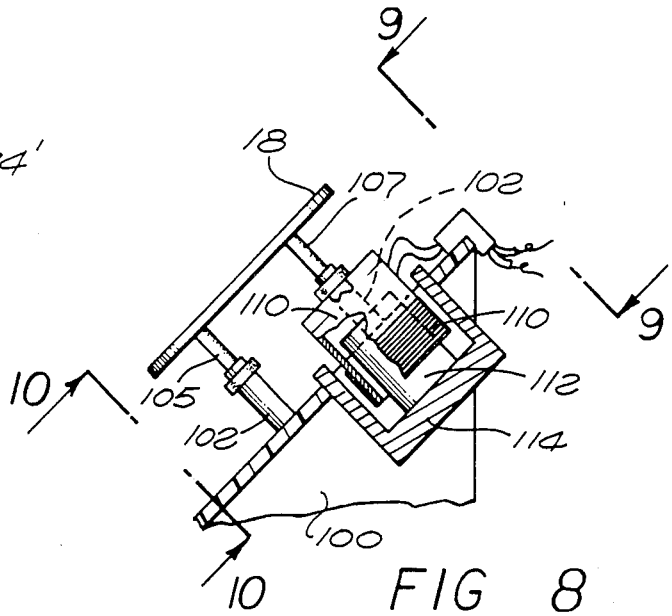
FIG 8
FIG. 9
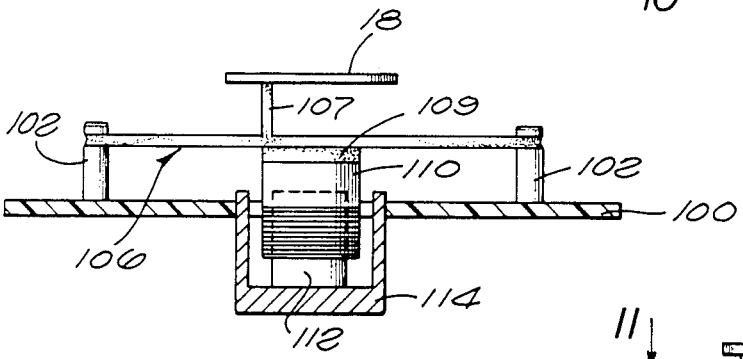
FIG. 10
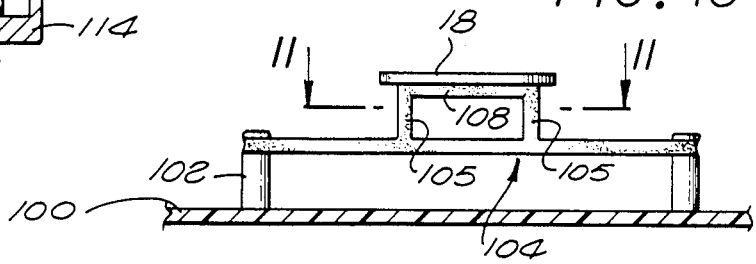
FIG. 11
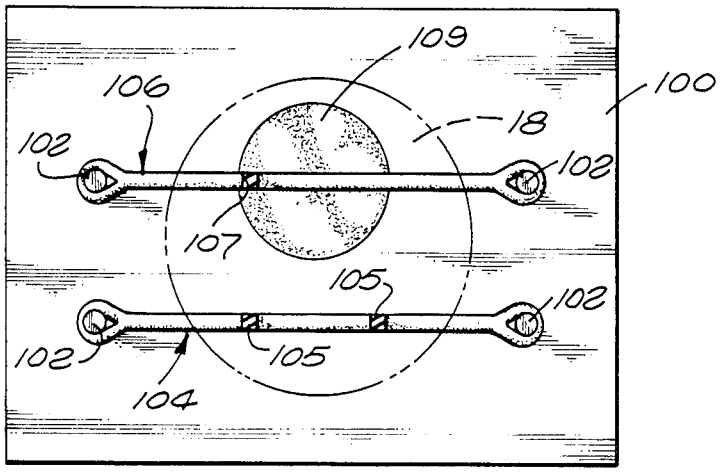

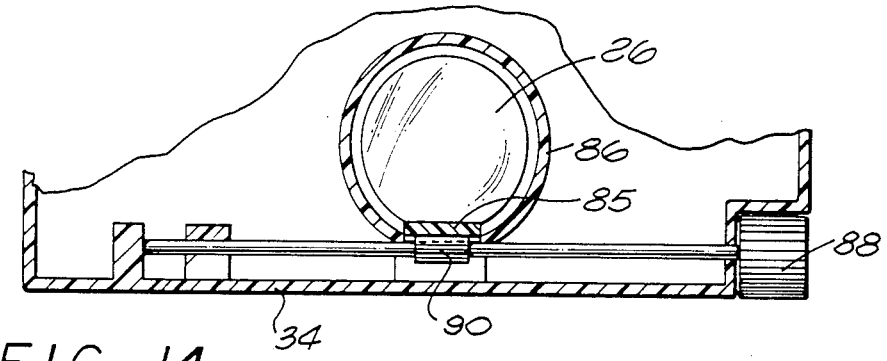
FIG. 14
FIG. 15
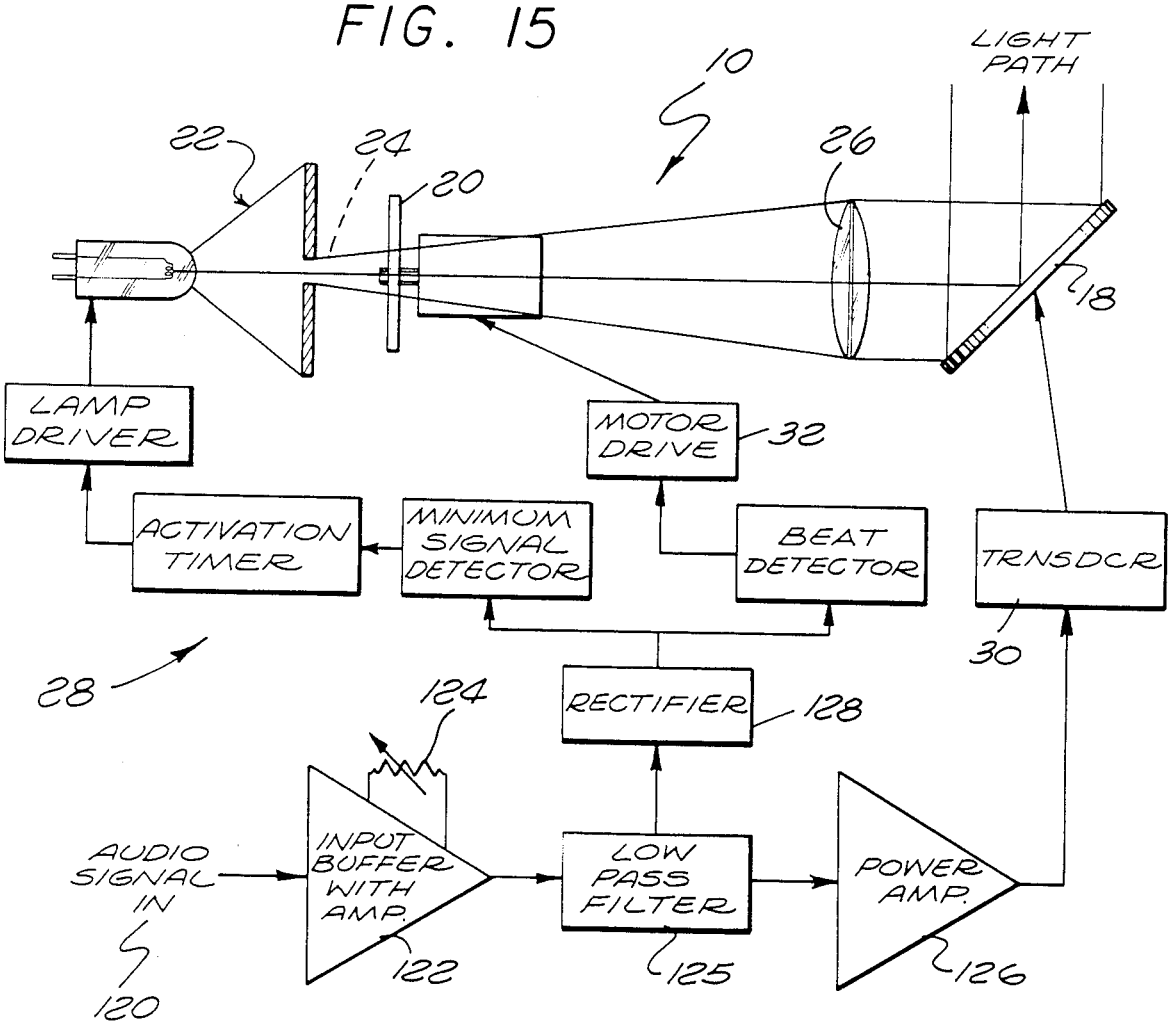

LIGHT SHOW PROJECTOR

BACKGROUND OF THE INVENTION

This invention relates generally to improvements in devices for producing pleasing and varying visual patterns or displays in generally synchronous relation with a variable input signal, such as music. More particularly, this invention relates to a highly compact and portable light show projector designed to provide laser-like visual line patterns in response to a music signal or the like.

In the prior art, a wide variety of visual display and projector devices are known for use in creating multicolored, changing visual images in response to varying characteristics of an input signal such as music. Such devices, some of which are known as "color organs," are popularly used at social gatherings and the like to produce esthetically pleasing visual images which change in color, size, and/or pattern in general synchronism with music being played. The resultant combination audio and visual production can be especially pleasing and interesting to the listener/viewer.

In recent years, so-called laser light shows have become extremely popular wherein high powered, substantially collimated colored light beams are flashed about with changing direction, typically in rhythmic relation to modern rock or pop music. Such laser light shows have provided particularly attractive visual line-type patterns having an eye catching suddeness as they are flashed on and off during a musical performance. However, the size and cost of the requisite equipment for such laser shows has limited their practical use to commercial environments such as large theaters, concert halls, etc. An economical projector device for in-home viewing of a laser-type light show has not been available.

The object of the present invention is to provide an economical and portable light show projector for in-home use and the like, wherein the light show projector is designed to produce a realistic laser simulative light show in response to music or the like.

SUMMARY OF THE INVENTION

In accordance with the invention, a light show projector is provided for producing a variable line trace or pattern of light on a wall or the like in response to a driving input signal, such as music. The projector includes a dynamically supported mirror for movably reflecting a substantially point light source onto a wall or ceiling to produce a distinctive line pattern simulative of a laser light show. The mirror is displaced multidimensionally in response to selected characteristics of the driving input signal. Color means are also provided for varying the color of the projected line pattern in response to other characteristics of the input signal. The entire projector is contained within a compact and portable housing adapted for convenient in-home entertainment use to provide a large and highly entertaining visual display.

In the preferred form of the invention, a relatively high powered lamp having a condensed filament is mounted within a lamp casing having a narrow aperture positioned to aim a narrow beam of light for incidence upon the reflecting mirror. Accordingly, the filament and aperture cooperate to define the substantially point light source. Prior to incidence on the mirror, the light beam passes through a radial segment of a color wheel having multiple radial segments of different colors, and further through a focusing lens associated with appropriate adjustment means for varying the focal length of the projected light beam. The light beam is then reflected by the mirror onto the wall or ceiling of a room to provide a projected line pattern having a trace in accordance with the displacement of the mirror, and a color in accordance with the rotational position of the color wheel.

The projector includes a control circuit adapted for receiving the driving input signal, particularly such as a conventional audio output signal obtained from modern high fidelity music reproduction equipment or the like. The control circuit couples the input signal to a transducer which responds to selected characteristics of the input signal to displace the reflecting mirror in a complex, multidimensional manner in synchronism with the music. In the preferred form, the mirror is carried by resilient support means having active and passive support members coupled to the mirror in an asymmetric arrangement. The transducer comprises an electromagnetic transducer for displacing the active support member in synchronism with selected characteristics of the music. The driven active support member cooperates with the passive support members to displace the mirror in a complex, multidimensional movement which results is a projected line pattern having distinctive multidimensional characteristics without requiring use of multiple mirrors. The appearance of the projected line pattern is enhanced by variably driving the color wheel in accordance with other selected characteristics of the input signal.

In a preferred form, the mirror is driven generally in response to input signal frequency and amplitude, and the color wheel is driven in response to input signal beat. In addition, the control circuit includes a variably set input amplifier to select the size of the projected line pattern. The focusing lens is adjustable to focus the image on the selected projection surface.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a light show projector embodying the novel features of the invention;

FIG. 2 is a side elevation view of the light show projector of FIG. 1;

FIG. 3 is a top plan view of the light show projector, with an upper portion of the projector housing removed to show the construction and relative position of internal components therein;

FIG. 4 is an enlarged, exploded and fragmented transverse vertical sectional view taken generally on the line 4—4 of FIG. 3;

FIG. 5 is an enlarged side elevational view depicting a preferred lamp construction for use with the light show projector;

FIG. 6 is a fragmented and somewhat schematic side elevational view of the projector to depict the relative arrangement of components within the projector housing;

FIG. 7 is an enlarged transverse vertical sectional view taken generally on the line 7—7 of FIG. 3;

FIG. 8 is an enlarged fragmented side elevation view correspondingly generally with the encircled region 8 of FIG. 6, and illustrating construction details of a reflecting mirror for the projector and dynamic support means therefor;

FIG. 9 is a sectional view taken generally of the line 9—9 of FIG. 8;

FIG. 10 is a sectional view taken generally on the line 10—10 of FIG. 8;

FIG. 11 is a sectional view taken generally on the line 11—11 of FIG. 10;

FIG. 14 is an enlarged transverse vertical sectional view taken generally on the line 14—14 of FIG. 3;

FIG. 15 is a schematic block diagram illustrating the functional operation of the light show projector.

DETAILED DESCRIPTION OF THE PREFERRED EMBODIMENT

Figure 13:
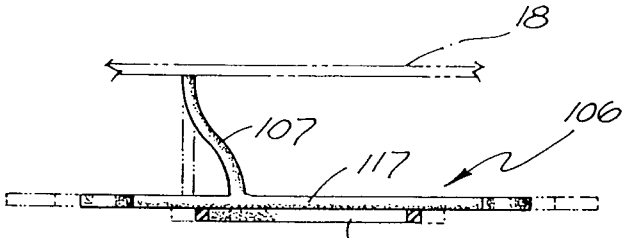
FIGS. 12 and 13 are elevational views showing active and passive support members, respectively, for resiliently supporting the reflecting mirror.

As shown in the exemplary drawings, an improved light show projector referred to generally by the reference numeral 10 is provided to produce a complex and multidimensional line pattern 12 on the wall or ceiling or other surface of a room, as viewed in FIG. 1. The line pattern 12 has a distinctive and highly pleasing visual appearance simulative of laser light beams and traces produced in the course of a modern commercial laser light show production. The line pattern 12 is adapted to vary in size, shape and color in accordance with a driving input signal, particularly such as a music signal obtained as an audio signal output from a tuner-/amplifier 14 or the like of a conventional music reproduction system of the type commonly used for in-home entertainment.

The light show projector 10 of the present invention advantageously comprises a relatively economical and self-contained system integrated into a compact and highly portable housing 16. The light show projector 10 utilizes a substantially point source of light in combination with a dynamically supported reflecting mirror 18 and a rotatable color wheel 20 (FIG. 3) to produce the line pattern 12 with a multidimensional and variable color appearance. The line pattern 12 is generated in synchronism with selected characteristics of the musical input signal to create an extremely realistic laser-like effect which varies with an eye catching instantaneousness. With certain types of musical input signals, particularly such as modern rock or pop music, the generated line pattern 12 appears to burst suddenly and in a large and continually changing manner which is extremely pleasing and interesting as a combined audio/visual experience to the listener/viewer. Importantly, however, the projector 10 is designed without the use of costly or bulky laser devices, thereby permitting the entire projector to be constructed economically and contained within the small housing 16 for in-home use and easy portability.

In general terms, as viewed diagrammatically in FIG. 15, the light show projector 10 includes the substantially point light source 22 for producing a narrow beam of light 24 aimed through the color wheel 20 and an adjustable focusing lens 26 for incidence upon the reflecting mirror 18. A control circuit referred to generally by reference numeral 28 receives the driving audio input signal for conditioning and filtering to drive the various projector components. More specifically, the control circuit 28 powers a transducer 30 in accordance with selected characteristics of the input signal to movably displace the mirror 18. In addition, the control circuit 28 powers a drive motor 32 for variably rotating the color wheel 20 preferably in accordance with other selected characteristics of the input signal. In the preferred form of the invention, as will be described in more detail, the transducer 30 is driven generally in response to input signal frequency and amplitude, and the color wheel motor 32 is driven generally in response to input signal beat. As a result, the light beam 24 reflected by the mirror 18 is swept through a varying path or trace with changing color to provide the music-related line pattern 12 (FIG. 1).

As shown in FIGS. 1–3, the housing 16 comprises a generally shell-shaped housing base 34 and cover 36 which may be conveniently and economically formed from lightweight plastic moldings or the like. When interconnected, the housing base 34 and cover 36 cooperate to define a substantially enclosed housing interior chamber for enclosing the projector components, as will be described. An on-off switch 40 is mounted at one side of the housing for controlling supply of electrical power to the projector via a power jack 42 (FIG. 3) adapted for receiving a power cord 44 which may be connected in turn to a standard household ac power supply or the like. An ac-dc transformer 43 is desirably mounted within the housing for converting the ac power input to an appropriate dc power output for operating the various components of the projector. An indicator light 45 is conveniently provided adjacent the on-off switch 40 to provide visual indication when the projector is in an "on" condition. An audio input jack 46 (FIG. 2) is mounted at the opposite side of the housing for plug-in reception of an appropriate conductor 48 (FIG. 1) for supplying the driving input signal to the projector.

As shown best in FIG. 3, the interior of the projector housing 16 includes a pair of transversely extending divider walls 50 and 51 to separate the housing interior into multiple compartments. More particularly, the divider wall 50 cooperates with the housing base 34 and cover 36 to define a rearward lamp compartment 52 having a projector lamp 54 mounted therein. The lamp 54 comprises a relatively small incandescent bulb which is substantially enclosed within the compartment 52 by means of a generally cup-shaped casing 56 (FIGS. 3 and 4) fastened by screws 57 or the like onto the housing base 34. This casing 56 is desirably black in color to minimize or eliminate stray lamp reflections during projector operation, and further includes a series of laterally open air vents 58 to permit circulation of cooling air into contact with the lamp 54. The lamp 54 is supported within the casing 56 by a generally V-shaped lamp stand 60 having lower feet 62 retained within recessed seats 64 by an access panel 66 mounted by screws 67 or the like onto the housing base 34. The access panel 66 is removable from the exterior of the housing base 34 to permit access to and replacement of the lamp 54, as may be required on a periodic basis. To guard against undesired leakage of light through the access panel during projector operation, a resilient gasket 65 is securely clamped between the access panel 66 and the housing base 34.

When the projector lamp 54 is illuminated, light produced by the lamp 54 is permitted to exit the lamp casing 56 in a forward direction through an opening 68 in the lamp casing (FIGS. 3 and 4). This light passes further through a small aperture 69 formed in the divider wall 50, wherein this divider wall is also black in color to prevent undesired or stray reflections. The aperture 69 in the divider wall is spaced relatively closely in front of the lamp 54 and has a relatively small size less that the diametric size of the lamp bulb 70 (FIG. 6). With this construction, internal lamp reflections from the bulb surfaces are substantially prevented from passing through the small aperture 69. Instead, the aperture limits light passage substantially to the light generated directly by the lamp filament 72.

The preferred form of the projector lamp 54 comprises a relatively high power halogen lamp having a condensed filament 72 capable of producing a brilliant, substantially point or concentrated light source. More particularly, with reference to FIG. 5, the preferred lamp 54 comprises a halogen lamp bulb 70 of the G-4 Stiff Pin type. The bulb includes a pair of conductors 74 extending into the bulb interior. The conductors 74 are joined to filament leads 75 which project forwardly initially in parallel and are then bent angularly toward each other to a centered and condensed filament coil 76. For best results, the preferred lamp 54 comprises a relatively high intensity source for producing at least about 20 MSCP (Mean Spherical Candle Power. Such lamp cooperates effectively with the divider wall aperture 69 to define a substantially point source of light for the projector, with any internal reflections from the bulb surfaces and/or from the angled filament leads 75 being filtered out by the small aperture.

The resultant narrow light beam 24 passing through the aperture 69 enters a central compartment 77 of the housing for passage through a radial segment 78 of the color wheel 20 to impart a selected color to the projected beam. The color wheel 20 is positioned substantially immediately in front of the aperture 69 for incidence of the beam thereon as a small spot 24', as viewed in FIGS. 3, 6 and 7. The color wheel 20 comprises a thin transparent film member defined by multiple radial segments 78 of different sequential colors, with four radial quadrants being shown by way of example in FIG. 7. Although the particular colors and sequence of the radial segments may vary, relatively bright colors arranged in sequence for high contrast, such as a sequence of yellow, green, red, and blue, are preferred.

The color wheel 20 includes a central hub 80 mounted on the drive shaft 81 of the color wheel drive motor 32. As previously described, this drive motor 32 is variably driven in a start-stop fashion by selected characteristics of the input signal to vary the color imparted to the light beam 3. Accordingly, as depicted in FIG. 3, the drive motor 32 is electrically connected by leads 82 to a circuit board 84 within the housing 16, wherein this circuit board 84 carries the various elements of the control circuit 28 to be described in more detail.

The colored light beam passes further from the color wheel 20 through the focusing lens 26 mounted within the projector housing 16. More particularly, as shown in detail in FIGS. 3 and 14, the focusing lens 26 comprises a standard optical lens mounted in any suitable manner upon a gear rack 85 for sliding adjustable movement within a cylindrical lens tube 86. The light beam is generally aligned to pass through the lens 26 at the central axis thereof, such that the lens may be used to alter the focal length position of the light beam in accordance with the location of the wall or ceiling or other surface onto which the generated line pattern 12 (FIG. 1) is projected. In a preferred embodiment of the invention, the focusing lens 26 comprises a simple plastic focusing lens adapted to provide variable focus within the range of from about 1.5 feet to infinity relative to the projector housing. Lens translation within the lens tube 86 for adjustment purposes is obtained quickly and easily by means of an external adjustment knob 88 which is manually rotatable to displace an adjustment gear 90 (FIG. 14) engaged with the of the lens-carrying gear rack 85.

The focused light beam 24 from the focusing lens 26 is incident upon the reflecting mirror 18. As viewed in FIGS. 3 and 6, this reflecting mirror 18 is supported within the housing 16 in a forward compartment 92 located in front of the housing divider wall 51, and in operative relation with the transducer 30. Conveniently, this divider wall 51 is black in color and assists in preventing undesired light, other that the narrow beam 24, from reaching the mirror. The mirror 18 is resiliently supported at a normal angularly set position of about 45° relative to the light beam 24 to redirect the beam from the housing 16 through a transparent pane 96 formed in the housing cover 36. A protective shroud 98 of flat black color is also conveniently mounted within the forward compartment 92 in surrounding relation to the mirror 18 to assist further in blocking undesired reflections and to conceal the transducer 30 from view.

The mirror 18 is resiliently supported within the forward compartment 92 upon an angularly oriented bracket 100 suitably connected to and upstanding from the housing base 34 (FIGS. 6 and 8). As shown in detail in FIGS. 8–11, the mirror bracket 100 includes a plurality of four relatively short upstanding posts 102 arranged in a generally rectangular array. A pair of resilient support members 104 and 106 of a stretchable rubberlike band material or the like have looped ends for reception over the posts 102 in a stretched configuration orienting the support members 104 and 106 in taut, generally parallel relation. The support member 104 is trisected by a pair of upstanding resilient support legs 105 which may be interconnected at their upper ends by a short bridge strip 108. In contrast, the support member 106 includes a single upstanding resilient support leg 107 at a position offset from the center of the support member 106. The pair of support legs 105 and the single support leg 107 are secured to a reverse side of the mirror 18 by a suitable adhesive material or the like, whereby these support legs 105 and 107 cooperatively provide a three-point triangular support footplate for the mirror. In the preferred form, these three resilient support legs are secured to the mirror in a position generally asymmetric with respect to the mirror.

The resilient support member 104 comprises a passive support structure for the mirror 18. That is, the resilient support member 104 and its associated pair of support legs 105 are not positively driven to apply displacement forces to the mirror 18 during operation of the light show projector. However, the resilient support member 106 comprises an active support structure for the mirror 18 and is positively driven by the transducer 30 to displace the mirror.

More specifically, the active resilient support member 106 further includes a centrally positioned and downwardly opening cylindrical cap 109 having a size and shape to fit snugly about the upper end of an electromagnetic coil 110 coupled to the control circuit 28. This coil 110 forms a portion of the transducer 30 and is slidably positioned in turn over a magnet 112 within a transducer cup 114 on the mirror bracket 100. The coil 110 is therefore mounted for electromagnetic displacement to move the resilient support member 106 linearly toward and away from the mirror 18 when a changing electrical current is coupled to the coil. Such displacement functions to vibrate the mirror 18 for purposes of displacing the incident light beam 24. Importantly, as viewed in FIG. 11, the support leg 107 is positioned generally at the periphery of the coil cap 109 such that the support leg 107 transmits the coil motion asymmetrically to the mirror 18, with the two passive support legs 105 deformably resisting mirror displacement. As a net result, the moving coil 110 functions to displace the mirror 18 in a highly complex and multidimensional fashion to create a large and extremely interesting visual line pattern 12 (FIG. 1).

Figure 12:
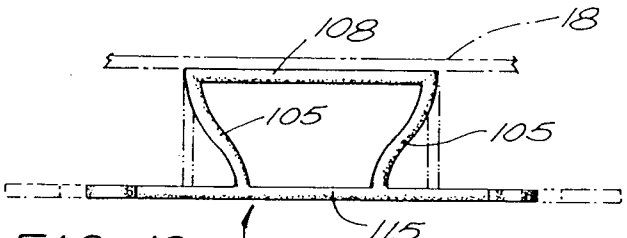

It has been found that the pleasing and interesting nature of the generated line pattern 12 is enhanced by the use of the resilient support members 104 and 106 constructed in nondeformed state as shown in FIGS. 12 and 13. More particularly, FIG. 12 shows the resilient support member 104 to include a resilient primary band 115 adapted for longitudinal stretching and mounting over a related pair of the bracket posts 102. This primary band 115 is joined to the upstanding support legs 105 having, in the nondeformed state, a curved shape extending upwardly and outwardly to the upper bridge strip 108. When the primary band 115 is stretched for mounting onto the bracket posts 102, the support legs 105 are reoriented to substantially parallel configurations (FIG. 10) to support the mirror 18, without significantly stretching the bridge strip 108. Similarly, as viewed in FIG. 13, the active support member 106 comprises a longitudinally stretchable primary band 117 together with the single support leg 107. The support leg 107 has a nondeformed curved geometry adapted for reconfiguration into a straight, generally upright shape when the primary band is stretched over the related pair of bracket posts 102. With this construction, the support legs 105 and 107 may be secured to the reverse side of the mirror 18 before the primary bands are mounted onto the associated bracket posts.

Figure 16:
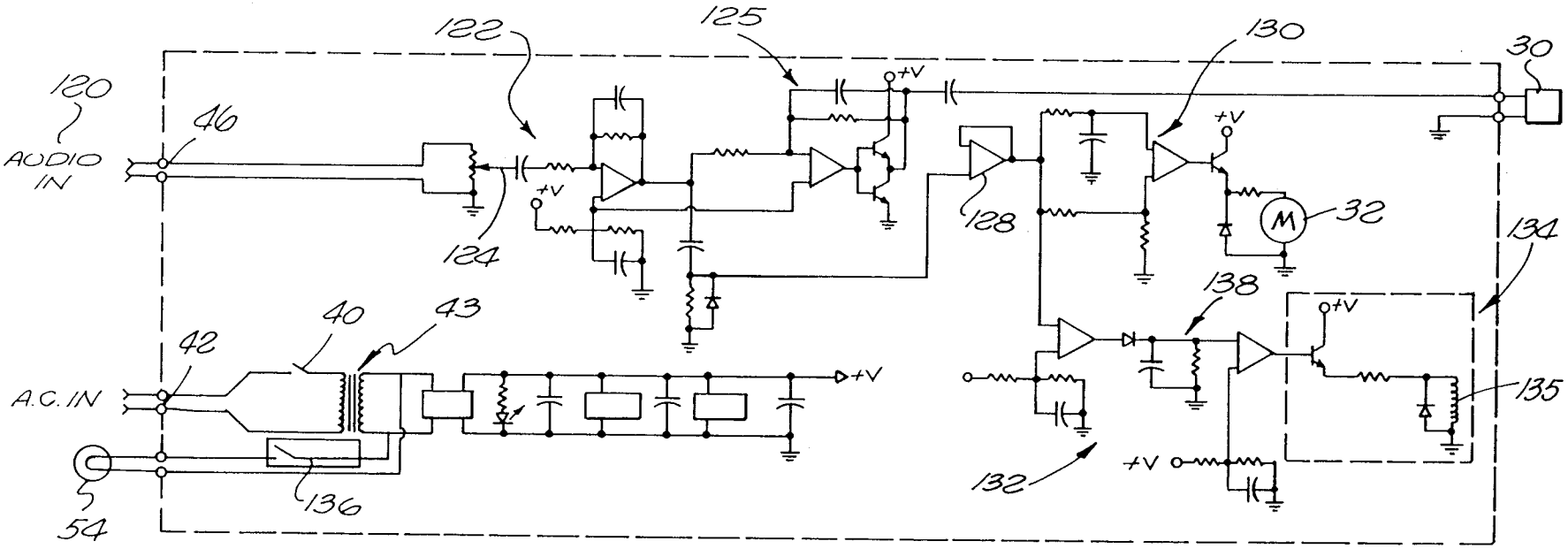
FIG. 16 is a schematic circuit diagram depicting an exemplary control circuit for the light show projector.

FIGS. 15 and 16 illustrate electronic components of the control circuit 28, in accordance with one preferred working embodiment of the invention. More specifically, an audio input signal 120 such as music is coupled via the audio jack 46 to an initial amplifier circuit 122 associated with a slide-type gain adjustment control 124 or the like on the housing 16 (FIG. 2) to select the gain thereof. The amplified signal is coupled to a filtering circuit 125 designed to remove relatively high frequencies from the input signal, since such frequencies are generally incapable of driving the transducer 30, as will be described. A filtered signal is then coupled through one or more power amplifiers 126 to the transducer 30 for displacing the mirror 18 in a manner generally corresponding with frequency and amplitude characteristics and variations of the music signal.

The filtered signal is also coupled through a rectifier 128 in parallel to a beat detector circuit 130, and to a minimum signal detector circuit 132. The beat detector circuit 130 includes a voltage divider which functions to produce a drive signal applied to the color wheel drive motor 32 in response to major beats in the music signal. The minimum signal detector circuit 132 responds to the presence of a music at a given minimum threshold to insure illumination of the lamp 54. In this regard, the circuit 132 includes a lamp activator circuit 134 which uses a relay coil 135 to close a relay switch 136 to provide electrical power to the projector lamp. A timer circuit 138 is conveniently provided as part of the minimum signal detector circuit 132 to insure lamp illumination for at least a minimum time period, such as about 0.5 seconds, each time a minimum threshold music signal level is detected. With this arrangement, the lamp 54 is deactivated during prolonged lulls in the music, such as between musical selections, and is then re-activated with a sudden burst of light and color when the music is resumed.

In use, when electrical power is supplied to the projector 10 together with an appropriate music input signal or the like, the transducer-driven mirror 18 reflects the light beam 24 with a complex vibratory motion synchronized with respect to the music being played. By appropriate adjustment of the focusing lens 26 to control image focus, and adjustment of the amplifier gain control 124 to control the size of the projected line pattern 12, a highly effective laser simulative light trace is produced on the wall or ceiling of a room. The generated line pattern 12 has a distinctive multidimensional appearance to the observer, as a result of the complex interactions of the active and passive support members 104 and 106 acting asymmetrically on the mirror 18. In general terms, the geometric shape of the projected image 12 tends to follow the music frequency, whereas the image size tends to be related to the amplitude of the music signal. The esthetically pleasing effect is further enhanced by the changing image color attributable to varying rotation of the color wheel 20 which, in the preferred form, tends to rotate in an on-off manner and at a rotational speed which is functionally related to rhythmic beat duration and magnitude. Still further, the overall image size can be varied with the control 124 to provide an unusually large projected image, if desired.

FIG. 1 shows the light show projector 10 in one typical orientation for use, wherein the housing 16 is angularly supported in a generally upright position to project the light pattern 12 upwardly and outwardly from the mirror 18. In this regard, the projector 10 may be conveniently equipped with a small fold-up stand 150 adapted to engage one of several rear transverse ridges 152 on the housing base 34 (FIG. 2) to support the projector in a selected angularly upright orientation. A resilient antiskid strip 154 at the lower edge of the base 34 assists in maintaining the projector in the angularly upright position without slipping from the support stand 150. Alternately, the projector may be operated as viewed in FIG. 2 with the housing base 34 resting flat upon a support surface such as a table or the like to project the line pattern 12 upwardly toward a ceiling or the like. In either case, the focusing 26 is appropriately adjustable to focus the reflected light beam as a small spot on the selected projection surface. For certain types of music, such as loud rock music or the like, the amplifier gain control 124 will normally be set to provide an expansive area to the overall line pattern 12 to enhance the combined audio-visual effect. In this regard, the mirror 18 is supported by the resilient support members in a unique manner permitting substantial angular deflection of the mirror of as much as about 30°–45° in any direction from an initial rest position. In one prototype embodiment of the invention, constructed as described above, the mirror 18 was positioned about seven feet from the projection surface and produced an image 12 having a span of about fourteen feet.

A variety of further modifications and improvements to the light show projector described herein will be apparent to those skilled in the art. For example, it will be understood that the specific characteristics of the music to which the color wheel 20 and/or the transducer 30 respond may vary. Further, it will be understood that the specific construction and operation of the control circuit 28 may take on a variety of different forms known to those skilled in the art, whereby the specific circuit components have been described herein in functional terms only. Accordingly, no limitation on the invention is intended by way of the foregoing description and the accompanying drawings, except as set forth in the appended claims.

What is claimed is:

1. A light show projector for use in projection of a light beam onto a projection surface, said projector comprising:

a projector housing;

a substantially point light source mounted within said housing, said light source producing a narrow light beam;

color means for imparting variably changing color to said light beam;

means for focusing said light beam;

a mirror for reflecting the light beam outwardly from the housing for projection onto the projection surface;

resilient support means for movably supporting said mirror relative to said housing, said resilient support means including at least, one active resilient support member coupled to said mirror and at least one passive resilient member coupled to said mirror;

a transducer mounted on said housing and including means for movably driving said at least one active resilient support member; and means for variably displacing said transducer in general synchronized relation with an audio input signal, whereby said mirror is movably displaced by the combined driven action of said at least one active resilient support member and resistive action of said at least passive resilient support member to displace said mirror in an .complex and multidimensional manner producing a complex line pattern of changing color on the projection surface.

2. The light show projector of claim 1 wherein the audio input signal comprises a music signal.

3. The light show projector of claim 2 further including means for playing the music signal concurrently with supply of said music signal to displace said transducer.

4. The light show projector of claim 1 wherein said substantially point light source comprises an incandescent lamp having a light-generating filament, and means for confining said lamp within a substantially closed compartment within said housing, said lamp confining means defining a narrow aperture for permitting said light beam to escape from said compartment for incidence upon and reflection by said mirror.

5. The light show projector of claim 4 wherein said lamp includes a bulb having said filament contained therein, said aperture having a narrow size less than the size of said bulb to prevent significant passage therethrough of reflections emanating from said bulb.

6. The light show projector of claim 5 wherein said lamp filament comprises a pair of conductors extending into said bulb, a pair of filament leads joined to said conductors, said filament leads being angled toward each other and connected to opposite ends of a filament coil.

7. The light show projector of claim 1 wherein said color means includes a rotatable color wheel having multiple radial segments of different color, means for mounting said color wheel generally adjacent said light source for passage of said light beam through one of said radial segments, and means for rotatably driving said color wheel.

8. The light show projector of claim 7 further including a control circuit having said audio input signal coupled thereto, said control circuit including means for providing a first control signal coupled to said transducer for driving said transducer in accordance with selected characteristics of the audio input signal, and means for providing a second control signal coupled to said color wheel driving means for driving said color wheel in accordance with selected different characteristics of the audio input signal.

9. The light show projector of claim 7 wherein said first control signal drives said transducer generally in accordance with the frequency and amplitude of the audio input signal, and wherein said second control signal drives said color wheel driving means generally in accordance with the beat of the audio input signal

10. The light show projector of claim 1 further including a control circuit for generating a first control signal coupled to said transducer for driving said transducer in accordance with selected characteristics of the audio input signal, said control circuit further including amplifier means for amplifying the magnitude of said first control signal, and a gain control mounted on the exterior of said housing for variably setting said amplifier means to select the magnitude of said first control signal.

11. The light show projector of claim 1 wherein said focusing means comprises a focusing lens mounted within said housing, and further including means accessible from the exterior of said housing for variably positioning said focusing lens to select the focal length of said light beam.

12. The light show projector of claim 1 wherein said active and passive support members comprise an active resilient support band and a passive resilient support band, and means for mounting said support bands on said housing in a generally taut condition, said passive support band including at least one support leg coupled to and supporting said mirror, and said active support band including at least one support leg coupled and supporting said mirror, said transducer being coupled to and movably driving said active support band.

13. The light show projector of claim 12 wherein said transducer comprises an electromagnetic coil movably supported with respect to said housing within a magnetic field, said audio input signal being coupled to said coil.

14. The light show projector of claim 12 wherein said support legs of said active and passive . support bands are coupled to said mirror in a generally asymmetric support pattern.

15. The light show projector of claim 14 wherein said passive support band includes a pair of said support legs and said active support band includes a single support leg, said support legs being coupled to and supporting said mirror in an asymmetrically positioned triangular pattern.

16. The light show projector of claim 15 wherein said transducer comprises an electromagnetic coil movably supported with respect to said housing within a magnetic field, said single support leg of said active support band being positioned off center with respect to said coil.

17. A light show projector for use in projection of a light beam onto a projection surface, said projector comprising:

a light source for producing a narrow light beam;

a mirror for reflecting said light beam onto the projection surface;

resilient support means for movably supporting said mirror, said support means including at least one active resilient support member coupled to said mirror and at least one passive resilient support member coupled to said mirror;

a transducer for movably driving said at least one active resilient support member; and signal means for displacing said transducer.

18. The light show projector of claim 17 wherein said said active and passive support members comprise an active resilient support band and a passive resilient support band, and means for mounting said support bands in a generally taut condition in a position generally adjacent to each other, said passive support band including at least one support leg coupled to and supporting said mirror, and said active support band including at least one support leg coupled and supporting said mirror, said transducer being coupled to and movably driving said active support band.

19. The light show projector of claim 18 wherein said transducer comprises an electromagnetic coil movably supported within a magnetic field, said signal means comprising an audio input signal coupled to said coil.

20. The light show projector of claim 18 wherein said support legs of said active and passive support bands are coupled to said mirror in a generally asymmetric support pattern.

21. The light show projector of claim 20 wherein said passive support band includes a pair of said support legs and said active support band includes a single support leg, said support legs being coupled to and supporting said mirror in an asymmetrically positioned triangular pattern.

22. The light show projector of claim 21 wherein said transducer comprises an electromagnetic coil movably supported within a magnetic field, said single support leg of said active support band being positioned off center with respect to said coil.

23. The light show projector of claim 18 further including means for variably changing the color of said light beam.

24. The light show projector of claim 18 further including a control circuit having said signal means coupled thereto, said control circuit including means for coupling selected portions of said signal means to said transducer, a light source activation circuit for detecting said signal means having a magnitude exceeding a predetermined threshold and for energizing said light source in response thereto, and a timer circuit for maintaining said light source energized for a predetermined minimum time period.

25. A light show projector for producing and projecting a relatively narrow light beam onto a selected projection surface such as the wall or ceiling of a room, said projector comprising:

a compact and portable housing;

means within said housing defining a substantially closed lamp compartment;

a projector lamp mounted within said lamp compartment, said compartment defining means including means forming a narrow aperture positioned closely adjacent said lamp for permitting passage of a narrow light beam from said compartment;

a color wheel having a plurality of radial segments of different color, and means for mounting said color wheel for rotation with one of said segments aligned with said aperture;

means for rotatably driving said color wheel for variably changing the color of said light beam;

focusing means within said housing for variably changing the focus of said light beam;

a mirror mounted within said housing for incidence thereon of said light beam and to reflect said light beam onto the selected projection surface;

a passive resilient support member for resiliently supporting said mirror, said passive support member including a primary resilient band, means for supporting said primary resilient band in a generally taut condition relative to said housing, and a pair of resilient support legs prcjecting generally in parallel relation from said primary resilient band and coupled to said mirror;

an active resilient support member for resiliently supporting mirror, said active support member including a primary resilient band, means for supporting said primary resilient band in a generally taut condition relative to said housing, and a resilient support leg projecting generally in parallel relation with said support legs of said passive support member and coupled to said mirror;

said support legs of said active and passive members being coupled to said mirror in a generally asymmetric pattern;

a transducer mounted within said housing and including a movable element coupled to said primary resilient band of said active support member; and a control circuit adapted to receive an audio input signal, said control circuit including means for producing a first control signal coupled to said transducer for driving said transducer in accordance with selected characteristics of said audio input signal, and means for producing a second control signal coupled to said color wheel driving means for driving said color wheel driving means in accordance with selected different characteristics of said audio input signal.

26. The light show projector of claim 25 wherein said first control signal drives said transducer generally in accordance with the frequency and amplitude of said audio input signal, and wherein said second control signal drives said color wheel driving means generally in accordance with the beat of said audio input signal.

27. The light show projector of claim 25 wherein said transducer comprises an electromagnetic coil supported within a magnetic field, and further including a cap on said active support member for fitting snugly over one end of said coil.

28. The light show projector of claim 25 further including means for variably amplifying the magnitude of said first control signal, said amplifying means including a movable gain control on the exterior of said housing.

29. The light show projector of claim 25 wherein said control circuit further includes a minimum signal detector circuit for detecting the presence of said audio input signal having a magnitude exceeding a predetermined threshold and for energizing said lamp in response thereto, and a timer circuit for maintaining said lamp energized for at least a minimum time period.

* * * * *